US009903205B2

(12) United States Patent
Reinhold

(10) Patent No.: US 9,903,205 B2
(45) Date of Patent: Feb. 27, 2018

(54) IMPELLER FOR A ROTOR OF A TURBOMACHINE, AND ROTOR AND TURBOMACHINE HAVING AN IMPELLER OF SAID TYPE

(71) Applicant: MAN DIESEL & TURBO SE, Augsburg (DE)

(72) Inventor: Bjoern Reinhold, Hamburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 734 days.

(21) Appl. No.: 14/383,369

(22) PCT Filed: Feb. 25, 2013

(86) PCT No.: PCT/EP2013/053738
§ 371 (c)(1),
(2) Date: Sep. 5, 2014

(87) PCT Pub. No.: WO2013/131774
PCT Pub. Date: Sep. 12, 2013

(65) Prior Publication Data

US 2015/0030456 A1 Jan. 29, 2015

(30) Foreign Application Priority Data

Mar. 7, 2012 (DE) ..... 10 2012 203 606

(51) Int. Cl.
*F01D 5/02* (2006.01)
*F01D 5/32* (2006.01)

(52) U.S. Cl.
CPC ..... *F01D 5/025* (2013.01); *F01D 5/326* (2013.01)

(58) Field of Classification Search
CPC . F01D 5/30; F01D 5/3007; F01D 5/32; F01D 5/323; F01D 5/326; Y10T 29/49321; Y10T 29/49863
See application file for complete search history.

(56) References Cited

U.S. PATENT DOCUMENTS 2,846,183 A 8/1958 Morgan
3,759,633 A * 9/1973 Tournere ..... F01D 5/326 403/381

(Continued)

FOREIGN PATENT DOCUMENTS

EP 1 619 354 1/2006
GB 790350 2/1958

*Primary Examiner* — Christopher Besler
*Assistant Examiner* — Matthew P Travers
(74) *Attorney, Agent, or Firm* — Cozen O'Connor

(57) ABSTRACT

An impeller for a rotor of a turbomachine includes: a wheel disc mounted on the rotor, the wheel disc having plural grooves arranged along a circumference of the wheel disc and extending in the thickness direction of the wheel disc. A toothed profile is formed on two sides of each groove. A plurality of impeller blades each have one root with two sides on each of which one toothed profile is formed. Each blade is inserted into a groove so as to form a blade-groove combination with the toothed profiles of the root and of the groove in engagement. Each combination having a fixing device that fixes the blade in the groove in the thickness direction and in the radial direction of the wheel disc. Each fixing device has a recess movably received in the groove base.

6 Claims, 2 Drawing Sheets

(56) References Cited

U.S. PATENT DOCUMENTS

| | | | |
|---|---|---|---|
| 4,820,127 | A | 4/1989 | Cohen et al. |
| 7,467,925 | B2 | 12/2008 | Schröder |
| 2010/0183444 | A1 | 7/2010 | Stone |

* cited by examiner

IMPELLER FOR A ROTOR OF A TURBOMACHINE, AND ROTOR AND TURBOMACHINE HAVING AN IMPELLER OF SAID TYPE

CROSS-REFERENCE TO RELATED APPLICATIONS

This is a U.S. national stage of application No. PCT/EP2013/053738, filed on 25 Feb. 2013, which claims priority to the German Application No. 10 2012 203606.7, filed 7 Mar. 2012, the content of both incorporated herein by reference.

BACKGROUND OF THE INVENTION

1. Field of the Invention

The invention relates to an impeller for a rotor of a turbomachine, a rotor for a turbomachine equipped with such an impeller and a turbomachine having a rotor equipped with such an impeller.

2. Description of the Related Art

An impeller, a rotor and a turbomachine of the type mentioned at the outset are each known from DE 196 03 388 C1. In the case of the impeller described in this document, the moving blades are each fixed by a rivet both axially and also radially in their respective axial groove. During the mounting of the respective moving blade, such a rivet requires a widening of a closing head of the rivet and during the dismounting of the respective moving blade, working away (e.g., drilling away) of the closing head. These procedures are time-consuming and realize a defined radial clamping action of the moving blades in their respective axial grooves only conditionally during the mounting.

SUMMARY OF THE INVENTION

An object of the present invention is to provide an impeller such that the moving blades of that impeller can be mounted and dismounted with reduced time expenditure and can be fixed in their respective axial grooves with defined radial clamping action. Other objects of the invention are to provide a rotor for a turbomachine equipped with such an impeller and a turbomachine having a rotor equipped with such an impeller.

The above mentioned objects are achieved with an impeller, a rotor and a turbomachine as described herein.

According to a first aspect of the invention an impeller is provided for a rotor of a turbomachine, the impeller comprising: a wheel disc, which is to be provided on a rotor shaft of the rotor and which has a plurality of grooves, which are arranged distributed along an outer circumference of the wheel disc and each of which extends in a thickness direction of the wheel disc running axially of the rotor shaft; wherein on two groove sides located opposite one another and running parallel to the thickness direction of each groove a tooth profile each is formed; a plurality of moving blades, of which each comprises a blade root with two blade root sides facing away from one another and running parallel to the thickness direction, on which a tooth profile each is formed; wherein each moving blade subject to forming a moving blade-groove combination is inserted with its blade root into a respective groove of the grooves, so that the tooth profiles of the blade root sides are in engagement with the tooth profiles of the groove sides; and wherein each moving blade-groove combination comprises a fixing device, which is equipped to fix the moving blade against movement in the groove both in thickness direction and also in a radial direction of the wheel disc. The impeller according to the invention is characterized in that each fixing device comprises a recess which is closed on both sides at least in thickness direction in a underside of the moving blade facing a base of the groove and a bar, which is moveably received in the base of the groove, so that the bar is adjustable in radial direction in a controlled manner between an unlocking position in which the bar does not engage in the recess of the moving blade, and a locking position, in which the bar radially engages in the recess of the moving blade, so that it presses the moving blade radially to the outside with a predetermined force.

Because the recess at least in thickness direction is closed on both sides with side walls, the bar in the locking position provides a stop in the thickness direction on both sides for the side walls of the recess so that the moving blade is fixed against movement in thickness direction.

Because the bar in the locking position presses the moving blade radially to the outside with a predetermined force, a play provided in the tooth profiles of the groove sides and the blade root sides for mounting and dismounting the moving blade in the groove is used up and the moving blade subject to being loaded with a predetermined preload force in radial direction (radially to the outside) is fixed against movement in this direction. Through the controlled adjusting of the bar, the predetermined force or the predetermined preload force (radial clamping action) radially to the outside can be predefined in a simple and repeatable manner.

Because the bar can be sunk into its unlocking position, in which it is out of engagement with the recess of the moving blade, the play in the tooth profiles of the groove sides and the blade root sides can be enabled again, so that the moving blade, both during its mounting and also during its dismounting from the wheel disc, can be slid easily and quickly axially into the groove or out of the groove.

According to an embodiment of the impeller according to the invention, the recess is in the form of a depression in the lower side of the moving blade enclosed on all sides by material of the moving blade, such that a radial outermost end of the bar provided for engagement in the recess is formed complementarily to the recess.

With this configuration of the impeller according to the invention, fixing of the moving blade in the groove against a possible movement in a circumferential direction of the wheel disc is advantageously realized in addition.

According to a further embodiment of the impeller according to the invention, the recess is formed as a negative to the outer contour of a spherical dome, with the radially outermost end of the bar having a shape corresponding to the outer contour of this spherical dome.

With this configuration of the impeller according to the invention, a self-centering of the bar in the recess, and thereby a more accurate fixing of the moving blade and an easier introducing of the bar in the recess, is advantageously realized.

According to yet another embodiment of the impeller according to the invention, each fixing device in the wheel disc has a first passage running in radial direction, which opens into the groove at a first longitudinal end of the passage and in which the bar is fitted preferably with a clearance fit.

The first passage provides a sliding guide for moving the bar in a simple and sturdy manner. Preferably, the first passage is embodied as a bore that is easily produced.

According to yet a further embodiment of the impeller according to the invention, each fixing device comprises an actuating device, which is arranged on a second longitudinal end of the first passage for the controlled adjusting of the bar, the actuating device being equipped so that it can be activated from a lateral side of the wheel disc facing in the thickness direction for adjusting the bar.

Because the adjusting device can be activated from the lateral side of the wheel disc, this activation position is easily accessible to a mounting or dismounting person, as a result of which the respective time expenditure can be further reduced and the embodiment accuracy further improved.

According to an embodiment of the impeller according to the invention, the actuating device comprises a second passage, which running in the thickness direction of the wheel disc is formed in the wheel disc with an internal thread, so that the first passage with its second longitudinal ends opens into the second passage and a first longitudinal end of the second passage opens into the lateral side of the wheel disc, and a screw element, which from the lateral side of the wheel disc is screwed into the second passage and which is in contact with a radial innermost end of the bar, so that a moving of the screw element in the thickness direction of the wheel disc brings about a moving of the bar in the radial direction.

Realizing the actuating device with the screw element screwed into the second passage, which is preferably formed as a bore that is easy to produce, is particularly simple and sturdy, so that production costs for the actuating device are relatively low and service life and reliability are long and high respectively.

According to a further embodiment of the impeller according to the invention, a longitudinal end of the screw element provided for the contact with the bar is formed having a first cone shape, the radially innermost end of the bar being formed with a second cone shape, so that between respective outer surfaces of the first and of the second cone shape a line contact is realized.

This configuration of the impeller according to the invention provides a wedge slider arrangement, which in a particularly simple and sturdy manner realizes a directional change of the actuating movement.

According to yet another embodiment of the impeller according to the invention, the first cone shape has a cone angle of approximately 20 degrees.

This size of the cone angle provides a particularly advantageous compromise between self-locking, actuating force and actuating travel of the actuating device.

Provided according to a second aspect of the invention is a rotor for a turbomachine, wherein the rotor comprises at least one impeller according to any one, multiple or all of the embodiments of the invention described above in any conceivable combination.

Provided according to a third aspect of the invention is a turbomachine with a rotor, comprising at least one impeller according to any one, multiple or all of the embodiments of the invention described above in any conceivable combination.

The invention expressly extends also to such embodiments as are not defined by feature combinations from explicit references to the claims, as a result of which the disclosed features of the invention—insofar as this is technically practical, can be combined with one another as required.

BRIEF DESCRIPTION OF THE DRAWINGS

In the following, the invention is explained in more detail with the help of a preferred embodiment and making reference to the attached figures.

DETAILED DESCRIPTION OF THE PREFERRED EMBODIMENTS

Figure 1:
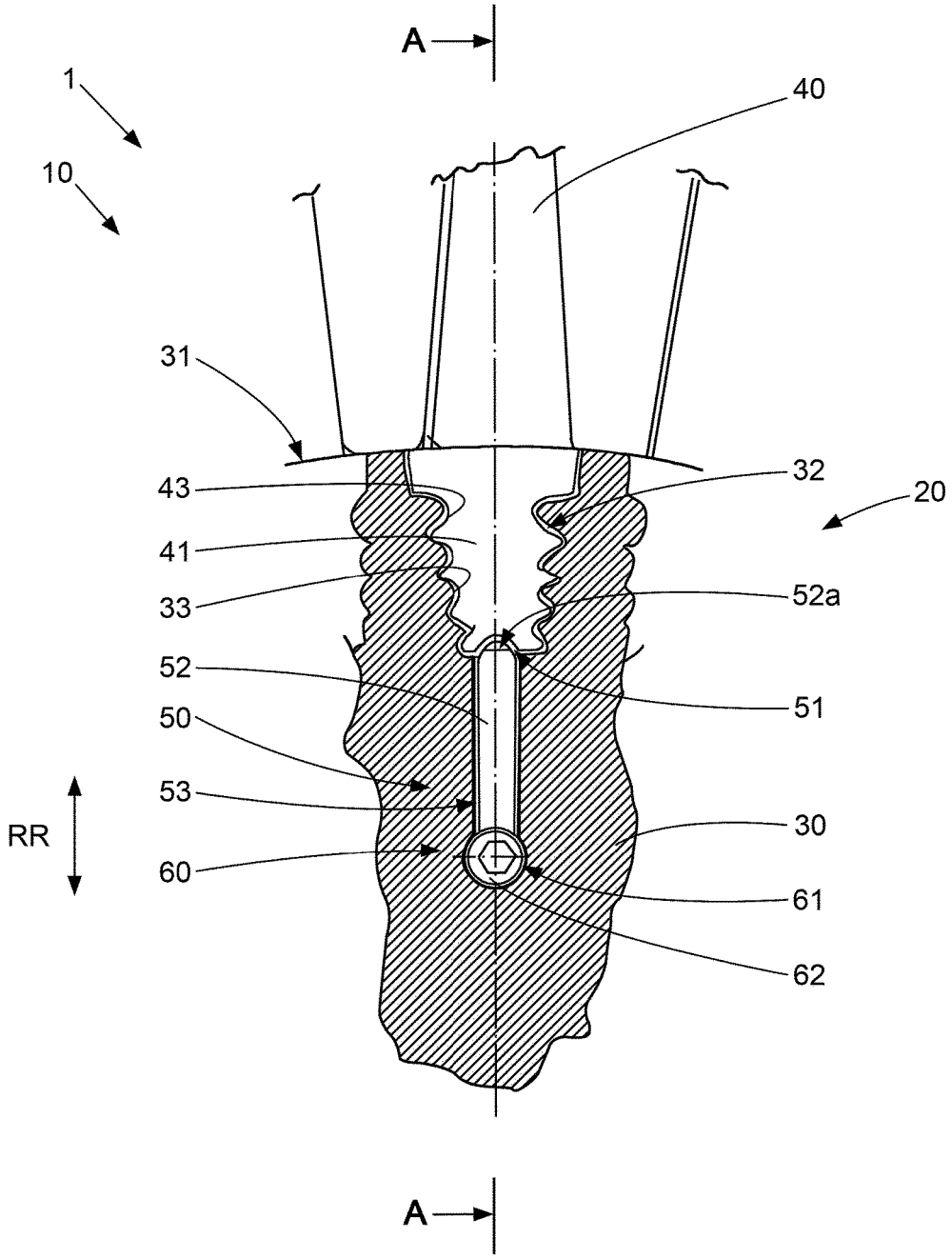
FIG. 1 shows a sectioned part view of an impeller of a rotor of a turbomachine according to an embodiment of the invention, viewed in an axial direction of the rotor.
Figure 2:
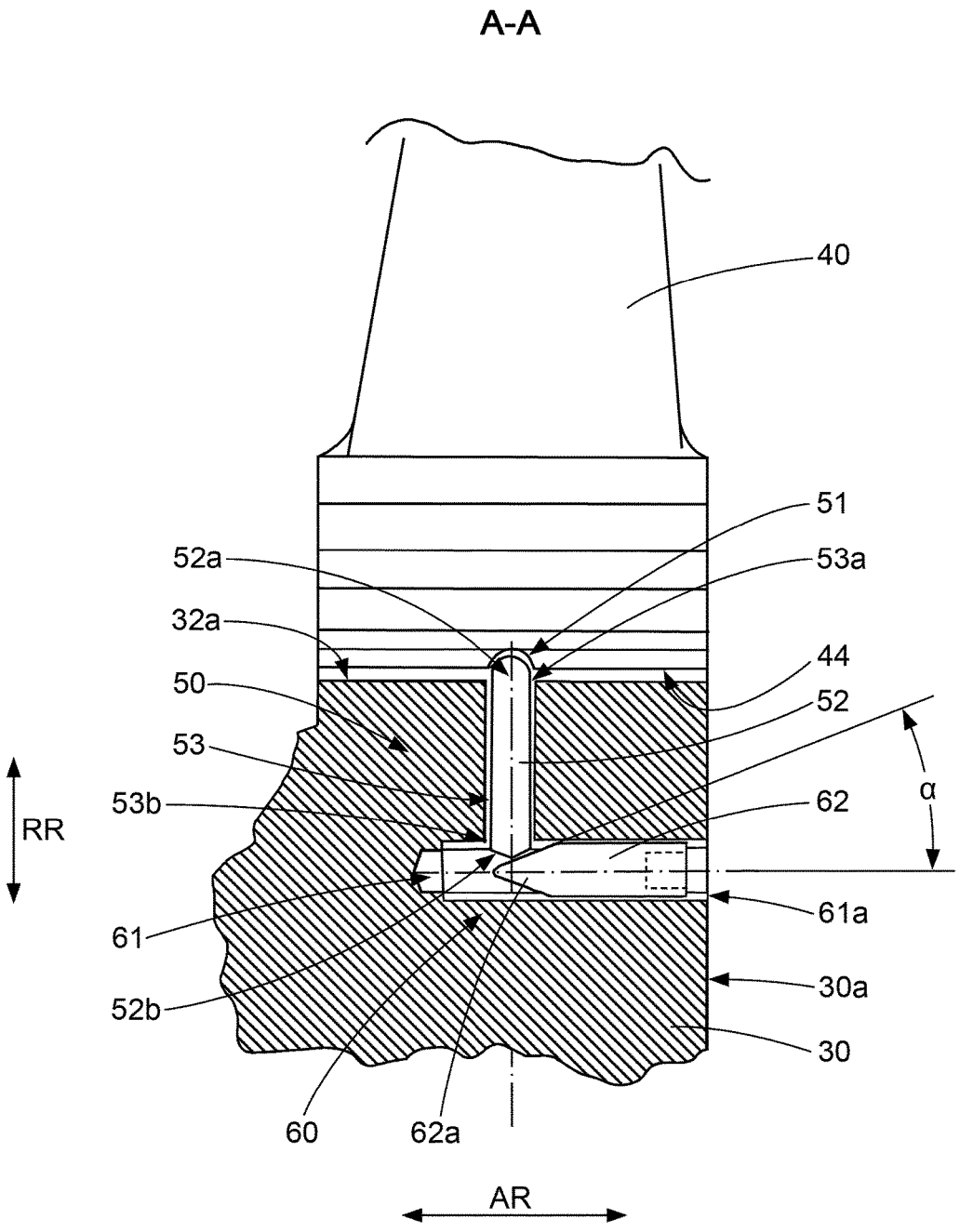
FIG. 2 shows a view of the impeller from FIG. 1, viewed as a section along a section line A-A in FIG. 1.

FIG. 1 and FIG. 2 show sectioned part views of an impeller 20 of a rotor 10 of a turbomachine 1 according to an embodiment of the invention.

The rotor 10 comprises a rotor shaft (not designated), on which multiple impellers 20 as shown in FIG. 1 and FIG. 2 are arranged one behind the other in an axial direction AR of the rotor shaft. The turbomachine 1 comprising the rotor 10 is preferably designed as a turbine, such as for example a steamed turbine or as a turbo compressor. In addition to this, the turbomachine 1 is preferably designed as an axial flow machine.

As is shown in FIG. 1 and FIG. 2, each impeller 20 comprises a wheel disc 30, a plurality of moving blades 40 (only one shown) and a plurality of fixing devices 50 (only one shown).

The wheel disc 30 is arranged either integrally therewith or as a separate part on the rotor shaft of the rotor 10 in a rotationally fixed manner and comprises a plurality of grooves (only one shown), which are arranged evenly distributed along an outer circumference 31 of the wheel disc 30 and which extend each in a thickness direction (which corresponds to the axial direction AR) of the wheel disc 30 running axially of the rotor shaft.

A tooth profile 33 is formed on each of the two groove sides of each groove 32, running parallel to the thickness direction or axial direction AR and located opposite one another.

Each moving blade 40 has a blade root 41 with two blade root sides facing away from one another and running parallel to the thickness direction or the axial direction AR, on each of which a tooth profile 43 is formed.

Each moving blade 40 is inserted with its blade root 41 into a respective one of the grooves 32 so as to form a moving blade-groove combination, so that the tooth profiles 43 of the blade root sides are in engagement with the tooth profiles 33 of the groove sides. In this way, the moving blades 40 are held on the wheel disc 30 in a radial direction RR of the wheel disc 30 or of the rotor shaft in a failsafe manner.

As is evident from FIG. 1, the tooth profiles 33, 43 of the groove sides and of the blade root sides, respectively, are preferably formed as multiple tooth profiles. Even more preferably, the blade roots 41 of the respective moving blades 40 are each designed as a blade root 41, also known in the art as a Christmas tree root. Accordingly, the grooves 32 of the wheel disc 30 are more preferably designed in their form as an envelope contour or negative to the form of a Christmas tree root.

Each combination of groove 32 and moving blade 40 fitted therein includes one of the fixing devices 50. Each fixing device 50 is configured to fix the associated moving blade 40 against movement in the associated groove 32 both in thickness direction or axial direction AR as well as in radial direction RR of the wheel disc 30.

For this purpose, each fixing device 50 comprises a recess 51, which is closed on both sides at least in thickness direction or axial direction AR in a underside 44 of the moving blade 40 facing a base 32*a* of the groove 32, and a bar 52, which is preferably designed in the form of a circle-cylindrical pin, which is moveably or shiftably received in the base 32*a* of the groove 32.

Each fixing device 50 additionally includes a first passage 53 running in the wheel disc 30 in the radial direction RR, which at a first longitudinal end 53*a* of the same opens into the groove 32 on the base 32*a* and in which the bar 52 is fitted with a clearance fit.

Each fixing device 50 additionally includes an actuating device 60, which is arranged at a second longitudinal end 53*b* of the first passage 53 for the controlled adjusting of the bar 52. The actuating device 60 is equipped so that it can be activated for adjusting the bar 52 from a lateral side 30*a* of the wheel disc 30 facing in the thickness direction or the axial direction AR.

In the illustrated embodiment, the actuating device 60 includes a second passage 61, which, running in the thickness direction or the axial direction AR of the wheel disc 30, is formed in the same with an internal thread (not designated) so that the first passage 53 with its second longitudinal end 53*b* opens into the second passage 61 and a first longitudinal end 61*a* of the second passage 61 opens into the lateral side 30*a* of the wheel disc 30.

In the illustrated embodiment, the actuating device 60 additionally including a screw element 62 configured in the form of a grub screw with internal hexagon (not designated), which from the lateral side 30*a* of the wheel disc 30 is screwed into the second passage 61 and which is in a sliding contact with a radially innermost end of the bar 52*b*, so that moving of the screw element 62 in the thickness direction or the axial direction AR of the wheel disc 30 causes moving of the bar 52 in the radial direction RR.

Expressed more precisely, a longitudinal end 62*a* of the screw element 62 provided for the contact with the bar 52 is configured with a first cone shape, wherein the radially innermost end 52*b* of the bar 52 is configured with a second cone shape, so that between respective outer surfaces of the first and of the second cone shape a line contact is realized. Preferably, the first cone shape has a cone angle $\alpha$ of approximately 20 degrees. Accordingly, the second cone shape preferably has a cone angle (not designated) of approximately 70 degrees.

Through the construction described above, the bar 52 is adjustable in the radial direction RR in a controlled manner between an unlocking position (not shown in the FIGS. 1 and 2) in which the bar 52 does not engage in the recess 51 of the moving blade 40, and a locking position (as shown in the FIGS. 1 and 2), in which the bar 52 radially engages in the recess 51 of the moving blade 40, so that it presses the moving blade 40 radially to the outside with a predetermined force.

Because the recess 51 is closed at least in the thickness direction or the axial direction AR on both sides with side walls, the bar 52 forms a stop on both sides in the thickness direction or the axial direction AR in the locking position for the side walls of the recess 51, so that the moving blade 40 is fixed against movement in the thickness direction or the axial direction AR.

Because the bar 52 in the locking position presses the moving blade 40 radially to the outside with a predetermined force, a play, which is provided in the tooth profiles 33, 43 of the groove sides and the blade root sides for the mounting and dismounting of the moving blade 40 in the groove 32, is used up and the moving blade thus fixed is subject to preloading with a predetermined preload force in radial direction RR (radially to the outside) against movement in this direction.

Through the described configuration of the actuating device 60, the predetermined force or the predetermined preload force (radial clamping action) radially to the outside can be predefined in a simple and repeatable manner, for example by a torque wrench for actuating the screw element 62.

Because bar 52 can be sunk into its unlocking position, in which it is out of engagement with the recess 51 of the moving blade 40, the play in the tooth profiles 33, 43 of the groove sides and of the blade root sides can be enabled again, so that the moving blade 40, both during its mounting and also during its dismounting from the wheel disc 30, can be slid easily and quickly axially into the groove 32 and out of the groove 32.

As is evident from viewing FIGS. 1 and 2 together, the recess 51 is preferably formed in the underside 44 of the moving blade 40 in the form of a depression that is enclosed on all sides by material of the moving blade 40 or of side walls, wherein a radially outermost end 52*a* of the bar 52 provided for the engagement in the recess 51 is designed complementarily in its shape to the shape of the recess 51. In the illustrated embodiment of the invention, the recess 51 is formed as an enveloping contour or negative to the outer contour of a spherical coupling (spherical segment or spherical portion), wherein the radially outermost end 52*a* of the bar 52 has a shape corresponding to the outer contour of this spherical dome. In other words, the recess 51 is configured as a spherical seat for the approximately semi-spherical radial outermost end 52*a* of the bar 52.

In conclusion, the impeller 20 according to the invention is configured so that its moving blades 40 can be mounted and dismounted with less time expenditure and can be fixed in their respective axially running grooves 32 with a defined radial clamping action.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An impeller (20) for a rotor (10) of a turbomachine (1), the impeller (20) comprising:

a wheel disc (30), arranged on a rotor shaft of the rotor (10) and having a plurality of grooves (32), the grooves (32) being arranged so as to be distributed along an outer circumference (31) of the wheel disc (30), each of the grooves (32) having a groove base (32*a*), and each of the grooves extending in a thickness direction of the wheel disc (30) running axially of the rotor shaft, wherein a groove side tooth profile (33) is formed on two groove sides of each groove (32) located opposite one another and running parallel to the thickness direction; and a plurality of moving blades (40), each having a blade root (41) with two blade root sides running parallel to the thickness direction and facing away from one another, on each of which a blade root tooth profile (43) is formed, wherein each of the moving blades (40) is configured to form a moving blade-groove combination when inserted with its blade root (41) into a respective one of the grooves (32), so that the blade root tooth profiles (43) of the blade root sides are in engagement with the groove side tooth profiles (33) of the groove sides, wherein each moving blade-groove combination comprises a fixing device (50) configured to fix the moving blade (40) against movement in the groove (32) both in the thickness direction as well as in a radial direction (RR) of the wheel disc (30), and wherein each fixing device (50) comprises a recess (51) closed on both sides at least in the thickness direction in an underside (44) of the moving blade (40) facing the groove base (32*a*), and a bar (52) is moveably received in the groove base (32*a*) so that the bar (52) is adjustable in the radial direction (RR) in a controlled manner between an unlocking position, in which the bar (52) does not engage in the recess (51) of the moving blade (40) and a locking position, in which the bar (52) radially engages in the recess (51) of the moving blade (40), so that the bar presses the moving blade (40) radially to the outside with a predetermined force wherein each fixing device (50) in the wheel disc (30) comprises a first passage (53) running in the radial direction (RR), which first passage (53) opens into the groove (32) on a first longitudinal end (53*a*) of said first passage (53) and into which the bar (52) is fitted, wherein each fixing device (50) comprises an actuating device (60), arranged on a second longitudinal end (53*b*) of the first passage (53) for the controlled adjusting of the bar (52), and wherein the actuating device (60) is configured to be activatable from a side (30*a*) of the wheel disc (30) facing in thickness direction for adjusting the bar (52), wherein the actuating device (60) comprises a second passage (61), configured in the thickness direction of the wheel disc (30) running in an internal thread, so that the first passage (53) with its second longitudinal end (53*b*) opens into the second passage (61) and a first longitudinal end (61*a*) of the second passage (61) opens in the lateral side (30*a*) of the wheel disc (30), and a screw element (62), which is screwed into the second passage (61) from the lateral side (30*a*) of the wheel disc (30) and which is operationally connected with a radially innermost end (52*b*) of the bar (52) so that a displacement of the screw element (62) in thickness direction of the wheel disc (30) brings about a displacement of the bar (52) in radial direction, and wherein a longitudinal end (62*a*) of the screw element (62) provided for the contact with the bar (52) has a first cone shape and wherein the radially innermost end (52*b*) of the bar (52) has a second cone shape, so that between the respective outer surfaces of the first and of the second cone shape line contact is realized.

2. The impeller (20) according to claim 1, wherein the recess (51) is a depression in the underside (44) of the moving blade (40) that is enclosed on all sides by material of the moving blade (40), and wherein the bar (52) has a radially outermost end (52*a*) configured to engage in the recess (51) complementarily to the recess (51).

3. The impeller (20) according to claim 2, wherein the recess (51) is negative to the outer contour of a spherical dome, and wherein the radially outermost end (52*a*) of the bar (52) has a shape corresponding to the outer contour of the spherical dome.

4. The impeller (20) according to claim 1, wherein the first cone shape has a cone angle ($\alpha$) of substantially 20 degrees.

5. A rotor (10) for a turbomachine (1), wherein the rotor (10) comprises at least one impeller (20) according to claim 1.

6. A turbomachine (1) with a rotor (10), which comprises at least one impeller (20) according to claim 1.

* * * * *